United States Patent [19]

Pollock et al.

[11] Patent Number: 4,778,376

[45] Date of Patent: Oct. 18, 1988

[54] GAS IGNITION

[75] Inventors: James F. Pollock, West Drayton; John M. North, Newbury; Roy F. Preston, Abingdon, all of United Kingdom

[73] Assignee: United Kingdom Atomic Energy Authority, London, England

[21] Appl. No.: 551,827

[22] Filed: Nov. 15, 1983

[30] Foreign Application Priority Data

Jan. 19, 1983 [GB] United Kingdom ..... 8301427

[51] Int. Cl.[4] ..... F23Q 7/00

[52] U.S. Cl. ..... 431/2; 431/258; 431/362

[58] Field of Search ..... 431/258, 2, 6, 326, 431/328, 261, 262, 264; 219/381; 361/253

[56] References Cited

U.S. PATENT DOCUMENTS

| | | | |
|---|---|---|---|
| 1,896,675 | 2/1933 | Miller | 431/264 |
| 3,459,924 | 8/1969 | McMichall | 219/381 |
| 3,507,627 | 4/1970 | Frank et al. | 219/381 |
| 3,688,083 | 8/1929 | Rice et al. | 219/381 |
| 3,782,886 | 1/1974 | Helke | 431/264 |
| 3,918,878 | 11/1975 | Rice | 431/258 |
| 4,257,157 | 3/1981 | Pollock et al. | 219/381 |
| 4,402,036 | 8/1983 | Hensley et al. | 431/258 |

FOREIGN PATENT DOCUMENTS

| | | | |
|---|---|---|---|
| 2133932 | 11/1972 | Fed. Rep. of Germany | 219/381 |
| 2432904 | 2/1975 | Fed. Rep. of Germany | 219/381 |
| 1283352 | 7/1972 | United Kingdom | 219/381 |
| 1444461 | 7/1976 | United Kingdom | 219/381 |
| 2056829 | 3/1981 | United Kingdom | 431/6 |

OTHER PUBLICATIONS

*Lange's Handbook of Chemistry*, "Properties of Combustile Mixtures", (11-16); New York; McGraw Hill Book Co. (1979).

*Primary Examiner*—Samuel Scott
*Assistant Examiner*—Carl D. Price
*Attorney, Agent, or Firm*—William R. Hinds

[57] ABSTRACT

A method of gas ignition comprises energizing a permeable, porous electric heating element to an appropriate temperature for igniting a gas, and allowing the gas to contact the heating element.

6 Claims, 1 Drawing Sheet

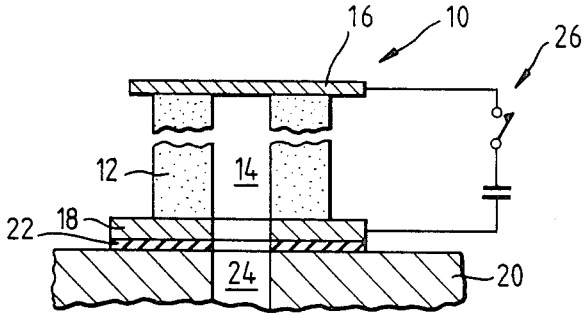
16
10
26
12
14
22
18
24
20

GAS IGNITION

This invention relates to the ignition of an ignitable gas, for example the ignition of hydrocarbon gas in domestic or industrial gas cookers or water heaters.

One form of electrically energised fuel igniter is disclosed in European Patent Publication No. 0007198A1-which describes the use of an electrically conductive carbide, boride, silicide, nitride, oxide, or other ceramic monofilment as a heating element. Such monofilament fuel igniters suffer from the disadvantage that the filament needs in many cases to be operated at very high temperatures in order to be able to transfer sufficient heat to the surrounding gas flowing over the filament for ignition to occur.

The present invention therefore provides in one aspect, a method of igniting an ignitable gas, the method comprising, energising an igniter comprising a permeable porous electric heating element comprising a fibrous body of electrically conductive material, the body having a voidage of between 50% and 98%, so as to heat the heating element to a temperature for igniting the gas, and directing the gas such that at least a portion of the gas permeates the heating element and is heated to the ignition temperature of the gas.

The gas may be directed angularly at the surface of the heating element, or such that the gas flows through the heating element from one side to the other thereof.

In another aspect, the invention provides an ignition apparatus for igniting an ignitable gas, the apparatus comprising a fluid permeable, porous electric heating element comprising a fibrous body comprising electrically conductive silicon-containing material with a voidage of between 50% and 90%, and means for directing the gas to permeate the heating element, the body having been heat treated at a temperature above the maximum temperature to which the body is to be heated and is subsequently heated by the ignited gas and such as to produce a desired electrical resistivity of the body, and wherein a catalytic coating has been applied to the body to reduce the temperature at which ignition of the gas is effected.

Conveniently, the heating element is of annular form having a bore which is closed at one end, and desirably, the gas is directed to the bore of the heating element so as to permeate through the heating element to the outside thereof.

The heating element may also be non-annular in form, and the gas directed to one side of the heating element so that the gas permeates through the heating element by dynamic pressure head and diffusion effects.

Advantageously, the heating element is formed of a material comprising electrically conductive silicon carbide, or silicon, or an electrically conductive mixture of silicon and silicon carbide, or silicon, carbon and silicon carbide, or silicon and silicon nitride, and may include a small amount of a dopant such as phosphorus or arsenic.

Conveniently the fibrous body may be provided by tubular fibres comprising a said material, the voidage being provided between the tubular fibres, and the tubular fibres might be hollow or might enclose therein a material which might be an electrical conductor or an electrical insulator.

The fibrous body may be made by the method described in British Patent Specifications Nos. 2056829A (U.S. Ser. No. 159,187 filed 13th June 1980) and 2111809A (U.S. Ser. No. 330,827 filed 15th Dec. 1981) which are incorporated by reference herein, and entails manufacturing an acrylic fibrous precursor having an open felt-like structure, for example by the method in British Patent Specification No. 1600253 (U.S. Pat. No. 4,257,157) which is also incorporated by reference herein. The precursor is then pre-oxidised and carbonised, and coated with a said material, and the precursor finally removed by oxidation in air to leave a fibrous body comprising tubular fibres of the said material. The desired electrical conductivity of the tubular fibres after oxidation to remove the carbonised precursor is obtained by choice of an appropriate temperature at which the oxidation of the carbonised precursor takes place, or alternatively by a prior or a subsequent heat treatment.

An important distinction provided by the invention over the afore-mentioned other form of igniter is the high surface area available for heat transfer to the surrounding gas permeating the igniter, with the consequence that the temperature at which heat transfer takes place can be considerably lower than would otherwise be required. This lower temperature not only reduces the radiation heat losses and improves the efficiency of the igniter but also reduces the size and cost of a voltage transformer in applications where one is needed. It will be understood that the gas may comprise a vapour, or a gaseous mixture, and may also contain liquid droplets which might themselves comprise combustible materials.

The invention will now be further described by way of example only with reference to the single FIGURE in the accompanying drawing which shows in medial section a representation of a gas igniter. Referring now to the FIGURE, an igniter 10 is shown and comprises a permeable porous electric heating element 12 of annular form having a bore 14 closed at one end by an upper metal electrode 16. The heating element 12 is mounted on a lower metal electrode 18 which is supported by a base 20 and electrically insulated therefrom by an annular insulating gasket 22. A duct 24 in the base 20 communicates through the gasket 22 with the bore 14 for the supply of a gaseous fuel thereto. An electric circuit 26 (shown in a simplified form) is connected across the upper electrode 16 and the lower electrode 18 to provide a 24 V electric supply to energise the heating element 12 to an ignition temperature of a hydrocarbon gas.

In operation, the heating element 12 is energised by the electric circuit 26, and the gas is fed under pressure through the duct 24 to the bore 14 of the heating element 12. The stagnation pressure of the gas in the bore 14 constrains the gas to permeate through the heating element 12 where it is heated to the ignition temperature of the gas.

If desired, air may be entrained in the gas before entry into the bore 14 of the heating element 12 so that a combustible mixture of air and gas is heated in the heating element 12, with combustion taking place within the matrix of the heating element 12. Many hydrocarbon gases may be ignited below 600° C. so that it is not necessary to heat the gas to a high temperature. Sufficient power must however be generated in the heating element 12 by the passage of the electric current to provide sufficient energy not only to raise the gas to the ignition temperature, but also to take account of the heat losses from the heating element 12 by conduction and radiation. Thus it is advantageous to operate the heating element 12 at the lowest feasible temperature above the gas ignition temperature so as to minimise power requirements.

The geometry and power generation characteristics of the heating element 12 may vary quite widely and will depend on the requirements of the particular industrial applicaiion. Important parameters affecting the heating element 12 geometry are, the gas flow rate through the heating element 12, the amount of air entrainment, the specific heat of the hydrocarbon gas, and the allowable pressure drop. The heating element 12 is suitable for a wide range of gas ignition applications, for example for domestic applications where small size is desirable. For a domestic application, the heating element 12 may comprise a body of electrically conducting tubular fibres (not shown), the gas permeating through a voidage or space provided between the tubular fibres. The tubular fibres might have a bore of about 5 to 300 μm and a wall thickness of between 5 to 100 μm. Since a small size of heating element 12 is desirable, such a heating element 12 might have an outside diameter of 3 to 10 mm, an inside diameter of 1 to 7 mm and a length of 2 to 10 mm. The bulk density of the heating element 12 might lie in the range 50 to 750 kg/m$^3$.

Methods of manufacturing a suitable electrically conducting heating element 12 are described in British Patent Specification Nos. 2056829A, 2083330A, and 2111809A, to which reference is directed for further information. An example of the manufacture of a silicon carbide element 12 is as follows:

An acrylic fibrous precursor having an open felt-like structure is made by the method described in the aforementioned British Patent Specification No 1600253. The precursor is then subjected to a pre-oxidation stage by heating in air or oxygen to between 140°–300° (preferably 170°–200°) and is carbonised at a temperature of from about 600° C. to 3000° C. (preferably 900°–1200° C.) in an oxygen free atmosphere (e.g. nitrogen, or argon). The carbonised precursor is subsequently coated with silicon and carbon by a plasma assisted vapour deposition process (PAVD) using for example a 60% Silane/40% Ethylene mixture as the reactant gases, and the carbonised precursor finally removed by oxidation in air at 600° C.–1400° C. to leave a heating element comprising silicon/silicon carbide tubular fibres which have been rendered electrically conductive with an electrical resistivity determined by the heat treatment temperature and the time thereat. This temperature must be above the maximum temperature to which the gas is to be heated, or the temperature to which the heating element 12 is heated by the gas after combustion, otherwise there will be a further change in heating element 12 resistance when the heating element 12 is operated.

A heating element 12 may be made by the above method from a carbonised precursor formed of a multiplicity of carbon fibres of about 5 to 300 μm diameter on which a silicon/silicon carbide coating of about 5 to 100 μm thick has been deposited on the carbon fibres. On oxidation of the carbonised precursor, a heating element 12 comprising silicon/silicon carbide tubular fibres having a wall thickness of about 5 to 100 μm is left.

Heating elements 12 of alternative materials may be made in a similar manner to that aforedescribed, and appropriate alternative coating processes may be used. If desired the oxidising step may be omitted, a suitable heat treatment in an inert atmosphere being used to arrange a desired electrical resistivity of the heating element 12, or alternatively a precursor of an electrical insulating material may be used as a substrate for coating.

Although the invention has been described in relation to the gas being fed to the bore of the heating element, the gas may be directed at the outside of the heating element and ignited at the bore. Alternatively, the gas may be arranged to flow over the outside of a heating element, the gas flowing either parallel to or at an angle to the outside surface of the heating element. One advantage of the angularly directed flow is the greater permeation of the heating element that occurs. It will be understood that a heating element of non-annular form may be used, for example a disc, or a rod for example cut from a larger heating element, an example of such a rod being 2 mm×2 mm in cross-section and 20–30 mm long. It will also be appreciated, that a coating of a suitable catalyst material may be applied to the heating element, for example to reduce the temperature at which ignition of the gas is effected.

We claim:

1. A method of igniting an ignitable gas, the method comprising, energising an igniter comprising a permeable porous electric heating element comprising a fibrous body of electrically conductive material, the body having a voidage of between 50% and 98%, so as to heat the heating element to a temperature for igniting the gas, and directing the gas such that at least a portion of the gas permeates the heating element and is heated to the ignition temperature of the gas.

2. A method as claimed in claim 1, wherein the gas is directed so as to permeate through the heating element from one side to another thereof.

3. A method as claimed in claim 2, wherein the sides are defined at least in part by an anular wall of the heating element so that the gas permeates through the wall.

4. A method as claimed in claim 1, wherein the gas comprises a gaseous mixture, at least one of the gases being ignitable.

5. Ignition apparatus for igniting an ignitable gas, the apparatus comprising a fluid permeable, porous electric heating element comprising a fibrous body comprising electrically conductive silicon-containing material with a voidage of between 50% and 98%, and means for directing the gas to permeate the heating element, the body having been heat treated at a temperature above the maximum temperature to which the body is to be heated and is subsequently heated by the ignited gas and such as to produce a desired electrical resistivity of the body, and wherein a catalytic coating has been applied to the body to reduce the temperature at which ignition of the gas is effected.

6. Ignition apparatus for igniting an ignitable gas, comprising, in combination, a fluid permeable, porous electric heating element comprising a fibrous body comprising eletrically conductive silicon-containing material with a voidage of between 50% and 98%, a supply of ignitable gas connected with said heating element, means for directing the gas to permeate the heating element, and electrical supply means for energising the electric heating element to a temperature for igniting the gas, the fibrous body having been heat treated at a temperature above the maximum temperature to which the body is to be heated and is subsequently heated by the ignited gas and such as to produce a desired electrical resistivity of the body, and the body including an applied catalytic coating to reduce the temperature at which ignition of the gas is effected.

* * * * *